US010450885B2

(12) United States Patent
Sedlov et al.

(10) Patent No.: US 10,450,885 B2
(45) Date of Patent: Oct. 22, 2019

(54) STATOR HEAT SHIELD FOR A GAS TURBINE, GAS TURBINE WITH SUCH A STATOR HEAT SHIELD AND METHOD OF COOLING A STATOR HEAT SHIELD

(71) Applicant: ANSALDO ENERGIA SWITZERLAND AG, Baden (CH)

(72) Inventors: Andrey Sedlov, Moscow (RU); Maxim Plodistyy, Balashikha (RU); Sergey Vorontsov, Moscow (RU)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 333 days.

(21) Appl. No.: 15/415,420

(22) Filed: Jan. 25, 2017

(65) Prior Publication Data

US 2017/0211405 A1 Jul. 27, 2017

(30) Foreign Application Priority Data

Jan. 25, 2016 (RU) ..... 2016102173

(51) Int. Cl.
*F01D 5/18* (2006.01)
*F01D 11/08* (2006.01)
(Continued)

(52) U.S. Cl.
CPC ..... *F01D 11/08* (2013.01); *F01D 11/24* (2013.01); *F01D 25/12* (2013.01);
(Continued)

(58) Field of Classification Search
CPC ..... F01D 11/08; F01D 11/10; F01D 11/24; F01D 25/12; F05D 2240/11; F05D 2240/15; F05D 2260/2212; F05D 2250/314
See application file for complete search history.

(56) References Cited

U.S. PATENT DOCUMENTS 4,013,376 A * 3/1977 Bisson ..... F01D 11/08 415/117
5,062,768 A * 11/1991 Marriage ..... F01D 5/186 29/889.721
(Continued)

FOREIGN PATENT DOCUMENTS

DE 19619438 A1 11/1997
EP 1 533 478 A2 5/2005
(Continued)

OTHER PUBLICATIONS

The extended European Search Report dated Jun. 9, 2017, by the European Patent Office in corresponding European Application No. 17153154.4. (10 pages).

*Primary Examiner* — Ninh H. Nguyen
(74) *Attorney, Agent, or Firm* — Buchanan Ingersoll & Rooney PC

(57) ABSTRACT

A stator heat shield for a gas turbine having a hot gas flow path, is disclosed. The stator heat shield includes a first surface configured to face the hot gas flow path of the gas turbine; a second surface opposite to the first surface; cooling channels for directing cooling fluid from the second surface towards the first surface; and cavities arranged at the first surface for receiving the cooling fluid from at least a part of the cooling channels; wherein at least a part of the cavities each have at least two corresponding cooling channels open thereto, the at least two corresponding cooling channels being inclined towards each other. In use, a vortex is created in the cavity.

26 Claims, 2 Drawing Sheets

(51) Int. Cl.
*F01D 25/12* (2006.01)
*F01D 11/24* (2006.01)

(52) U.S. Cl.
CPC ..... *F05D 2220/32* (2013.01); *F05D 2240/11* (2013.01); *F05D 2240/15* (2013.01); *F05D 2250/24* (2013.01); *F05D 2250/314* (2013.01); *F05D 2260/20* (2013.01); *F05D 2260/202* (2013.01)

(56) References Cited

U.S. PATENT DOCUMENTS 5,161,942 A * 11/1992 Chen ..... F01D 11/127 277/414
5,165,847 A 11/1992 Proctor et al.
5,169,287 A 12/1992 Proctor et al.
5,538,393 A 7/1996 Thompson et al.
5,660,523 A * 8/1997 Lee ..... F01D 5/20 415/115
6,139,257 A 10/2000 Proctor et al.
6,155,778 A 12/2000 Lee et al.
6,354,795 B1 3/2002 White et al.
7,988,410 B1 8/2011 Liang
8,475,121 B1 * 7/2013 Liang ..... F01D 5/288 415/115
2005/0058534 A1 3/2005 Lee et al.
2005/0111965 A1 5/2005 Lowe et al.
2009/0035125 A1 2/2009 Fujimoto et al.
2012/0027576 A1 2/2012 Tibbott et al.
2012/0251295 A1 10/2012 Turner et al.
2014/0366545 A1 12/2014 Nakamata

FOREIGN PATENT DOCUMENTS

EP 2 549 063 A1 1/2013
WO WO 2013/129530 A1 9/2013

* cited by examiner

STATOR HEAT SHIELD FOR A GAS TURBINE, GAS TURBINE WITH SUCH A STATOR HEAT SHIELD AND METHOD OF COOLING A STATOR HEAT SHIELD

PRIORITY CLAIM

This application claims priority from Russian Patent Application No. 2016102173 filed on Jan. 25, 2016, the disclosure of which is incorporated by reference.

TECHNICAL FIELD

The invention relates to a stator heat shield for a gas turbine, a gas turbine provided with such a stator heat shield, and a method of cooling a stator heat shield.

BACKGROUND OF THE INVENTION

Cooling of a gas turbine Stator Heat Shield (SHS), particularly of first stage, is a very challenging task. Indeed, film cooling of hot gas exposed surface actively used for blading components is hardly applicable to the area where the rotating blade passes the SHS for two reasons. First, the complex flow field in the gap between SHS and blade tip does not allow for cooling film development and the resulting film effectiveness is low and hard to predict. Second, in case of rubbing events, cooling holes openings can be closed, thus preventing required cooling air outflow, which would have a detrimental effect on the whole cooling system and reduced lifetime.

As a result, very common practice for state-of-art SHS cooling is to use extensive impingement cooling with cooling air discharged from side faces of SHS through convective holes, which limits overall cooling effectiveness.

Further development of heavy duty gas turbine engines (e.g. for combined cycle) is focused on the raise of cyclic parameters: pressure ratio and hot gas temperature. In long-term perspective hot gas path components will be obliged to survive turbine inlet hot gas temperature of 2000-2200 K and available convective cooling schemes will not be feasible to guarantee proper lifetime of first stage SHS's even despite of noticeable increase of discharge areas and air-to-hot-gas pressure ratio.

The second potential issue caused by an excessive growth of turbine inlet temperature is the worsening of lifetime of blade tip region that is typically exposed by the most severe thermal conditions driven by geometrical restrictions and high turbulence level in the tip clearance region. To increase the lifetime in this specific area to an acceptable level it would require noticeable increase of cooling flow rates by opening discharge areas. This action would have a detrimental impact on overall turbine and engine efficiency. Moreover it should be stressed high discreteness between hot gas and coolant flows in the blade tip region and any local hot gas streak can cause a life-limiting location.

The majority of known cooling schemes for stator heat shields deals with mature manufacturing technologies (casting, machining, brazing) and conventional cooling features (impingement, pins and cylindrical holes).

The wider spread scheme is a combination of impingement with side discharge, as disclosed for instance in US 2012/0251295 A1 and U.S. Pat. No. 6,139,257. All these schemes are robust but due to the limitations within only convective cooling with discharge through long holes in front, side and rear of the SHS limits their cooling efficiency within the state-of-art level.

US2005/0058534 A1, U.S. Pat. No. 5,538,393 propose serpentine cooling schemes and EP2549063 A1 proposes helix shaped cooling scheme. Although the given cooling schemes are quite effective due to high heat utilization rates, again their cooling efficiency is limited by fixed coolant to hot gas pressure head and absence of any kind of external cooling. Special words should be said about low adjustability of design towards nonuniform external boundary conditions.

US2009/0035125 A1, U.S. Pat. Nos. 5,165,847, 5,169,287, 6,139,257, 6,354,795 B1 and EP 1533478 A2 propose impingement cooled SHS with cooling air ejection at hot has exposed surface. This schemes allow to maximize pressure head and impingement heat transfer rates and convective cooling efficiency of the components, however all those disclosures are suffering from the following: in case of rubbing event, risk of which always exists in heavy duty gas turbines, cooling hole exits can be closed thus preventing cooling airflow and consequently cause overheating of the SHS. Moreover due to positioning of discharge holes towards trailing edge of the blade, cooling of the blade tip is not considered in the aforementioned teachings.

US 2012/0027576 A1 and US 2012/0251295 A1 propose effusion cooling scheme revealing cooling air at the complete hot gas washed surface of SHS. Again, no mitigation against rubbing is given, and the part is critical for the installation in case of tight radial clearances.

WO2013129530A1 proposes an example of external "film" cooling organization within deep retaining grooves; however no cooling proposals to cool down thick metal area between the grooves were given.

BRIEF SUMMARY OF THE INVENTION

The present invention addresses to solutions of the aforementioned problems.

For the long-term further development when heavy duty gas turbine engines are struggling turbine inlet hot gas temperature of 2000-2200K, available convective cooling schemes will not be feasible to guarantee proper lifetime of first stage stator heat shields with adequate cooling air consumption. The second potential issue is the worsening of lifetime in tip region that is already exposed by most severe condition and requires breakthrough improvement of overall and local cooling efficiency. The proposed scheme of SHS cooling organization ensures required lifetime of both aforementioned components.

Therefore, one of the objects of the present invention is to improve the lifetime of a stator heat shield of a gas turbine, and of a blade tip of a rotor blade. A further object of the present invention is to improve the aerodynamics of the gas turbine, in particular to reduce tip clearance losses. A further object of the present invention is to save coolant.

The objects of the present invention are solved by a stator heat shield for a gas turbine, the gas turbine comprising a hot gas flow path, the stator heat shield comprising:

- a first surface adapted to be arranged to face the hot gas flow path of the gas turbine;
- a second surface opposite to the first surface;
- cooling channels for directing cooling fluid from the second surface towards the first surface;
- cavities arranged at the first surface for receiving the cooling fluid from at least a part of the cooling channels;
- wherein at least a part of the cavities each have at least two corresponding cooling channels open thereto, said at least two corresponding cooling channels being inclined towards each other.

The at least two corresponding cooling channels have each an inlet to receive cooling fluid at the second surface and an outlet to discharge a jet of cooling fluid into a respective cavity, said at least two corresponding cooling channels being arranged so that the jets of the cooling fluid discharged from said at least two corresponding cooling channels interact, providing thereby swirling of the cooling fluid in the cavity. The interaction of the jets of the cooling fluid allows the cooling fluid to swirl in the cavity and thereby be retained in the cavity before it is sucked out of the retaining cavity and mixed with hot gas. Therefore, the cavity according to the present invention is a retaining discharge cavity. The retaining discharge cavity according to the present invention allows external cooling of the SHS and at the same time to mitigate the impact of rubbing event preventing discharge holes from closure. The cooling fluid sucked out from the retaining discharge cavity reduces downstream exposure temperature at the SHS and the tip region of a passing blade. Furthermore, the use of the cavities according to the present invention allows minimization of radial tip clearance with a target to increase turbine performance.

The cavities according to the invention are configured so as to assist the swirling of the jets of the cooling fluid in the cavities, that is, to arrange a circulation of the cooling fluid. In particular the cavities expand towards the first surface. The cavities may be substantially hemispherical. Furthermore, the cavities may be oval as viewed from the first surface.

The at least two corresponding cooling channels may be inclined to the first surface of the stator heat shield at an angle between 20° and 40°, preferably between 25° and 35°, more preferably at an angle of 30°.

Said at least two corresponding cooling channels have each a central axis, and preferably said central axes of said at least two corresponding cooling channels are offset relative to each other so that the central axes of said at least two corresponding cooling channels do not intersect in a respective cavity. The inclined and offset channels allow a stable circulation of the cooling fluid in the cavity.

Preferably, said at least two cooling channels of at least one cavity intersect with though channels of other cavities to arrange intersections of two respective cooling channels, wherein the cooling channels are in fluid communication in the intersections. It is preferred that the central axes of said two respectively intersecting cooling channels are offset relative to each other so as not to be arranged in one common plane. In addition to the stable circulation of the cooling fluid in the cavity, this arrangement allows additional heat exchange in the intersection regions and high and uniform cooling heat transfer rate. This provides an internal convective cooling network.

To achieve the aforementioned objects of the inventions, it may be enough that said at least two corresponding cooling channels associated with a respective cavity comprise exactly two cooling channels inclined towards each other.

The central axes of said two cooling channels may be offset, preferably half-diameter offset, relative to each other so that the central axes of said two cooling channels do not intersect in a respective cavity. The two half-diameter offset channels allow the most stable circulation of the cooling fluid in the cavity.

In a preferred embodiment, one of said two cooling channels of one cavity intersect with one of the two cooling channels of a neighboring cavity to arrange a first intersection, wherein the cooling channels intersecting in the first intersection are in fluid communication. Preferably, the first intersection is located substantially between said one cavity and said neighboring cavity, as viewed as a projection onto the first surface. More preferably, said one of said two corresponding cooling channels of said one cavity intersect also with one of the two cooling channels of at least one cavity next to said neighboring cavity to arrange at least a second intersection, wherein the cooling channels intersecting in said at least second intersection are in fluid communication. The central axes of the cooling channels intersecting in a respective intersection are offset, preferably half-diameter offset, relative to each other so as not to be arranged in one common plane. In addition to the stable circulation of the cooling fluid in the cavity, this arrangement allows additional heat exchange in the intersection regions and high and uniform cooling heat transfer rate. This provides an internal convective cooling network. Varying the size of the cooling channels and offset value allows a very local optimization of cooling heat transfer rates.

In general, the circulation of the cooling fluid is possible if the axes of said two cooling channels converge in a respective cavity, as viewed in a plane perpendicular to the first surface of the stator heat shield.

To arrange a homogeneous external cooling network, the cavities may be arranged in rows extending in the longitudinal direction of the stator heat shield, as viewed from the first surface, and the rows of the cavities may be staggered.

The cooling channels may be provided as convective cylindrical channels or tubes.

The stator heat shield may be manufactured by readily conventional process, for example, by casting, machining, brazing as well as additive manufacturing method like Selective Laser Melting (SLM).

The present invention also relates to a gas turbine, comprising at least one stator heat shield as described above. The cooling fluid used in the gas turbine may be cooling air.

The present invention also relates to a method of cooling a stator heat shield, the stator heat shield having a first surface adapted to be arranged to face a hot gas flow path of a gas turbine;

a second surface opposite to the first surface cooling channels for directing cooling fluid from the second surface towards the first surface;

cavities arranged at the first surface for receiving the cooling fluid from at least a part of the cooling channels;

wherein at least a part of the cavities each have at least two corresponding cooling channels open thereto, said at least two corresponding cooling channels being inclined towards each other;

the method comprising the steps of causing cooling air to flow through the cooling channels and injecting the cooling gas flow of two cooling channels into one cavity, wherein the two cooling channels are offset such that the vortex is created in the cavity.

All the features mentioned above may be combined with each other to achieve the objects of the inventions.

The objects and aspects of the invention may also be seen from the following description of the invention.

The proposed innovative network cooling of the SHS is arranged by intersecting convective channels with an extraction of cooling air into specially profiled swirling retaining cavities that organize a stable low temperature circulation to the SHS externally. This cooling scheme is highly efficient and provides required lifetime and/or coolant savings. This utilization of SHS cooling air brings to the mixture temperature reduction in the blade tip clearance region, thus providing its lifetime improvement (or blade coolant reduction) and decrease of aerodynamic losses. The proposed cooling scheme is protected from rubbing, robust and is readily available for manufacturing by conventional or additive manufacturing methods.

PREFERRED EMBODIMENT OF THE INVENTION

Figure 1:
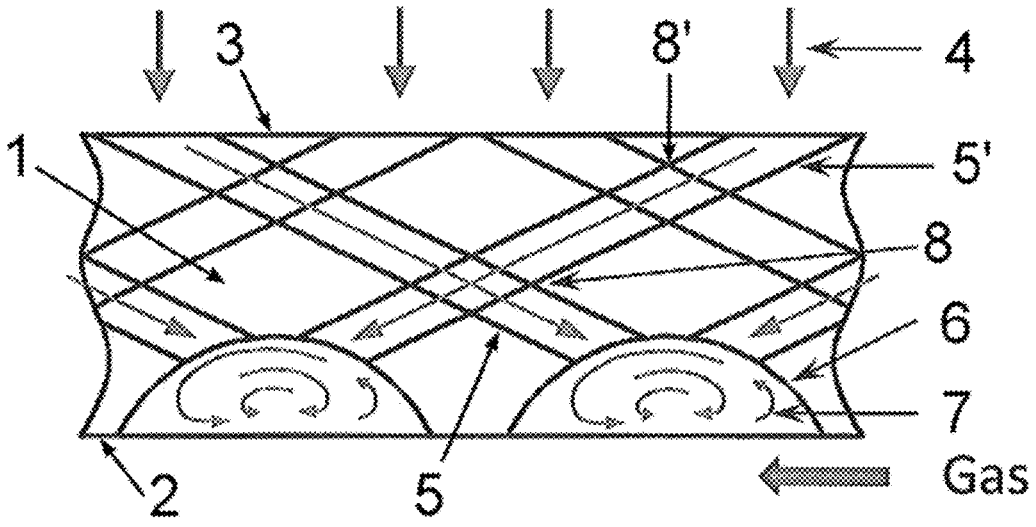
FIG. 1 shows a cross-sectional view of a segment of the stator heat shield according to the present invention, with a combination of intersecting cooling channels and retaining discharge cavities, and flow arrangement.

Referring to FIG. 1, a stator heat shield 1 for a gas turbine, particularly of first stage, comprises a first surface 2 adapted to be exposed to hot gases flowing through the gas turbine during the operation of the gas turbine, that is, to face a hot gas flow path of the gas turbine. Further, the stator heat shield 1 comprises a second surface 3 opposite to the first surface 2. The second face faces away from the hot gas flow path and is connected to a cooling fluid supply. During the operation of the gas turbine, the second surface 3 is exposed to cooling fluid 4. To direct the cooling fluid 4 from the second surface 3 towards the first surface 2, the stator heat shield 1 has through cooling channels 5, 5'. Each of the cooling channels 5, 5' has a feeding inlet to receive the cooling fluid 4 and an outlet to discharge a cooling fluid jet. Cavities 6 are provided on the first surface 2, which have a special profile with an expansion towards the first surface 2 washed by hot gas. The cavities are open to the hot gas flow path. Each cavity 6 has two cooling channels 5, 5' open thereto. The two cooling channels 5, 5' are inclined towards each other and arranged so as to provide a circulation 7 of the cooling fluid in the cavity 6. The cooling channels 5, 5' may be inclined to the surface of the SHS at optimal 30°.

The cavities 6 are profiled so as to allow a circulation 7 of the cooling fluid in the cavities 6. Due the circulation 7, the cooling fluid may be retained in the cavities 6 before it is sucked out of the retaining cavity 6 mixing with hot gas and reducing downstream exposure temperature at the SHS and the tip region of a passing blade. This arrangement allows external cooling of the SHS and, at the same time, mitigation of the impact of rubbing event, preventing thereby discharge holes from closure.

Additionally, the cooling channels 5, 5' extending through the body of the stator heat shield 1 define an internal convective cooling system of the SHS. Therefore, the cooling channels 5, 5' may be provided as convective channels or tubes.

To increase the internal cooling effect, the inclined cooling channels 5, 5' of one cavity 6 intersect with the inclined cooling channels 5, 5' of the other cavities 6 to arrange intersections 8, 8'. In this preferred embodiment, one 5 of the two cooling channels 5, 5' associated with one cavity 6 intersects with one 5' of the two cooling channels 5, 5' of a neighboring cavity 6 to arrange a first intersection 8. The first intersection 8 is located substantially between said one cavity 6 and said neighboring cavity 6, as a projection onto the first surface 2. Said one 5 of the two cooling channels 5, 5' associated with one cavity 6 may intersect also with one 5' of the two though channels 5, 5' of at least one cavity next to said neighboring cavity to arrange at least a second intersection 8'. Each intersection 8, 8' includes two intersecting cooling channels 5, 5'.

Figure 2:
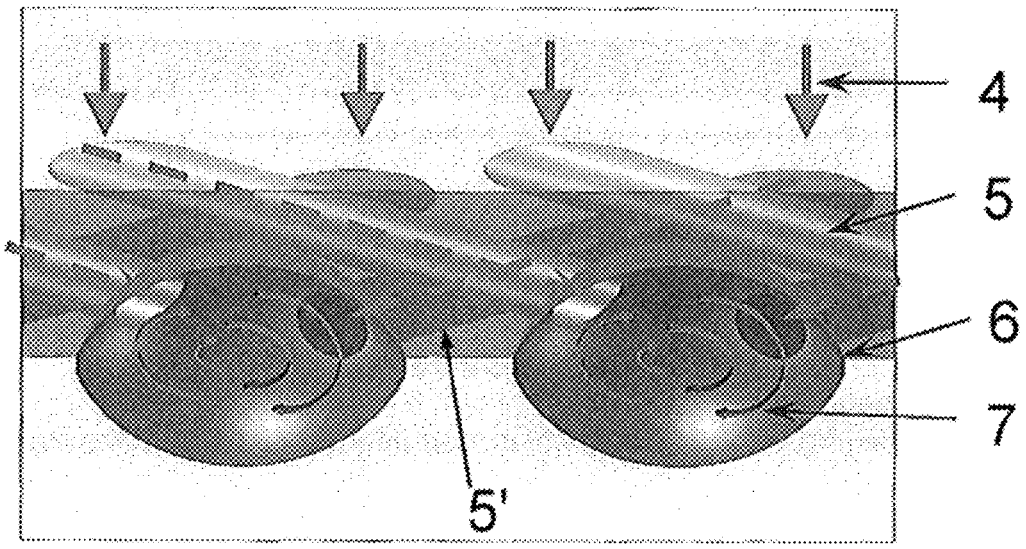
FIG. 2 shows an isometric view of the stator heat shield from FIG. 1.

Referring now to FIG. 2, it can be seen that the central axes of the two cooling channels 5, 5' open into the same cavity 6 are offset, preferably half-diameter offset, relative to each other to arrange swirling interaction between the discharged jets of the cooling fluid and thereby a more stable circulation 7.

Further, as can be seen in FIG. 2, the cooling channel 5 of one cavity 6 and the cooling channel 5' of another cavity 6 intersect with each other so that their axes are offset, preferably half-diameter offset, relative to each other so as not to be arranged in one common plane. The intersecting cooling channels 5, 5' are in fluid communication in the intersections 8, 8'. In application to cooling effect of the cooling channels, the intersection and offset of the though channels 5, 5' allows achievement of high heat transfer enhancement rates with moderate pressure losses.

Figure 3:
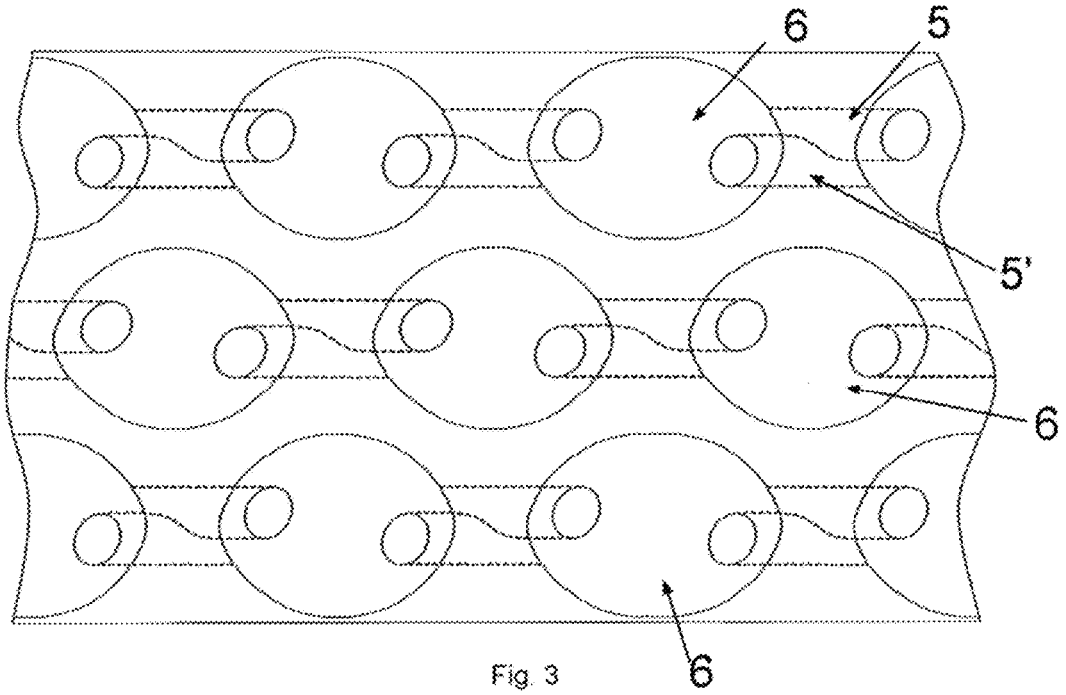
FIG. 3 shows a view from the first surface (hot has exposed surface) of the stator heat shield according to the invention with a staggered arrangement of the retaining discharge cavities.

Referring now to FIG. 3, the cavities 6 are arranged in rows extending in the longitudinal direction of the stator heat shield 1. The rows of the cavities 6 are staggered to arrange a homogeneous external cooling network. The offset of the central axes of the intersecting cooling channels 5, 5' can be also seen in FIG. 3, too.

Figure 4:
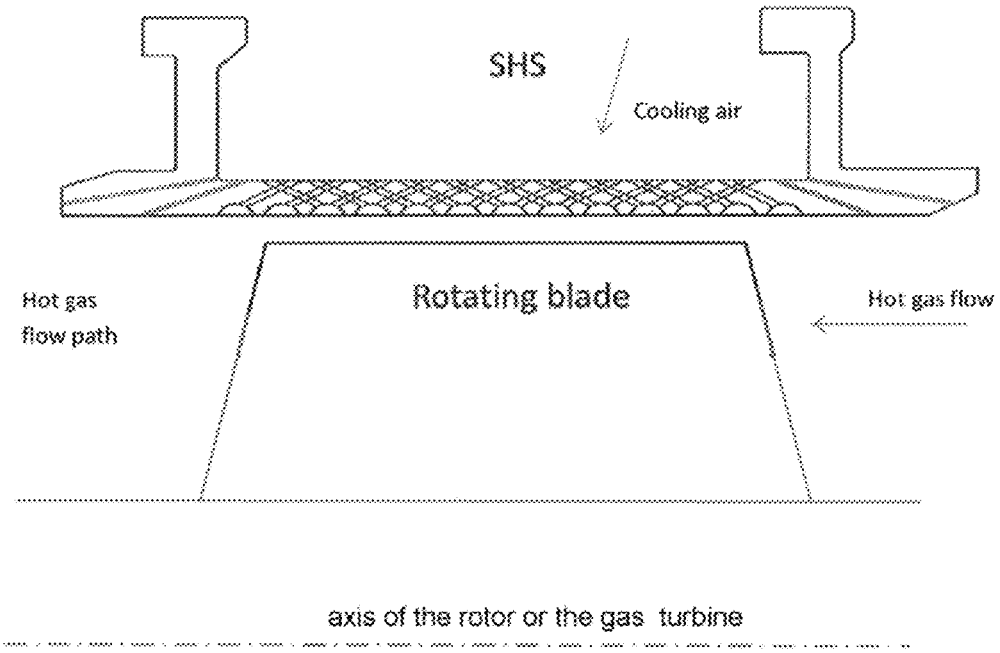
FIG. 4 shows a cross-sectional view of the stator heat shield according to the present invention, with a combination of intersecting cooling channels and retaining discharge cavities, arranged in respect to a blade of the rotor of the gas turbine.

FIG. 4 shows an example of implementation of the stator heat shield. In this example, the stator heat shield is facing the rotor. A plurality of the cavities are arranged on the side of the stator heat shield which is facing the hot gas flow side. Two cooling channels extend from the cooling air supply side to the hot gas flow path side of the stator heat shield and open into the cavities.

It is clear that varying the inclination angles of the cooling channels, the offset values of the cooling channels, the number of intersections, and the profile of the cavity allows achievement of a better circulation of the cooling fluid in the cavities, a better interaction of the cooling fluid in the intersections and thereby a better cooling effects.

It should be understood that the description and specific examples, while indicating the preferred embodiment of the invention, are intended for purposes of illustration only and are not intended to limit the scope of the invention. Variations that do not depart from the gist of the invention are intended to be within the scope of the invention. Such variations are not to be regarded as a departure from the spirit and scope of the invention.

Summarizing, the main aspects of the present invention distinguishing it from other schemes are the following:

- the use of internal cooling system built on the basis of highly efficient intersecting convective channels with preferably two intersections to achieve high and uniform cooling heat transfer rates;
- the use of angled discharge jets with half-pitch shift (half-diameter offset) and profiled retaining cavities allows a stable circulation of cooling air which is discharged into the cavities for external cooling;

the use of retaining cavities expanding towards hot gas washed surface provides mitigation of rubbing event and allows minimization of radial tip clearance with a target to increase turbine performance;

the use of air discharge to flowpath allows reduction of hot gas to coolant mixture temperature and improvement of thermal boundary conditions in blade tip region (to improve lifetime and/or reduce coolant consumption) and reduction of aerodynamic tip clearance losses;

the given cooling scheme of the SHS allows a very local optimization of cooling heat transfer rates (by varying the size of convective channels and offset value) in relation to external factors such as axial pressure distribution and hot gas wakes with a target to reach maximum uniformity of resulting metal temperatures and stresses in all locations and remove of all critical zones and provide maximum lifetime and/or coolant savings.

The invention claimed is:

1. A stator heat shield for a gas turbine having a hot gas flow path, the stator heat shield comprising:

a first surface configured to face a hot gas flow path of a gas turbine;

a second surface opposite to the first surface;

cooling channels for directing cooling fluid from the second surface towards the first surface; and cavities arranged at the first surface for receiving the cooling fluid from at least a part of the cooling channels;

wherein each cavity has at least two corresponding cooling channels open thereto, said at least two corresponding cooling channels being inclined towards each other, wherein said at least two corresponding cooling channels each have a central axis, and said central axes of said at least two corresponding cooling channels are offset relative to each other so that the central axes of said at least two corresponding cooling channels do not intersect in a respective cavity.

2. The stator heat shield according to claim 1, wherein said at least two corresponding cooling channels each comprise:

an inlet to receive cooling fluid at the second surface and an outlet to discharge a jet of cooling fluid into a respective cavity, wherein said at least two corresponding cooling channels are arranged so that the jets of the cooling fluid discharged from said at least two corresponding cooling channels interact, providing thereby swirling of cooling fluid in the cavity.

3. The stator heat shield according to claim 2, wherein the cavities are configured so as to promote the swirling of the cooling fluid in the cavities.

4. The stator heat shield according to claim 1, wherein the cavities expand towards the first surface.

5. The stator heat shield according to claim 1, wherein the cavities are substantially hemispherical.

6. The stator heat shield according to claim 1, wherein the cavities are oval as viewed from the first surface.

7. The stator heat shield according to claim 1, wherein said at least two corresponding cooling channels are inclined to the first surface of the stator heat shield at an angle between 20° and 40°.

8. The stator heat shield according to claim 1, wherein said at least two corresponding cooling channels are inclined to the first surface of the stator heat shield at an angle between 25° and 35°.

9. The stator heat shield according to claim 1, wherein said at least two corresponding cooling channels are inclined to the first surface of the stator heat shield at an angle of 30°.

10. The stator heat shield according to claim 1, wherein said at least two cooling channels of at least one cavity intersect with cooling channels of other cavities to arrange intersections of two respective cooling channels, wherein the cooling channels are in fluid communication in the intersections.

11. The stator heat shield according to claim 10, wherein the cooling channels each have a central axis, and the central axes of said two respectively intersecting cooling channels are offset relative to each other so as not to be arranged in one common plane.

12. The stator heat shield according to claim 1, wherein said at least two corresponding cooling channels associated with a respective cavity comprise:

two cooling channels inclined towards each other.

13. The stator heat shield according to claim 12, wherein the cooling channels each have a central axis, the central axes of said two cooling channels being offset relative to each other so that the central axes of said two cooling channels do not intersect in a respective cavity.

14. The stator heat shield according to claim 12, wherein one of said two cooling channels of one cavity intersects with one of the two cooling channels of a neighboring cavity to arrange a first intersection, wherein the cooling channels intersecting in the first intersection are in fluid communication.

15. The stator heat shield according to claim 14, wherein the first intersection is located substantially between said one cavity and said neighboring cavity, as viewed as a projection onto the first surface.

16. The stator heat shield according to claim 14, wherein said one of said two corresponding cooling channels of said one cavity intersect also with one of the two cooling channels of at least one cavity next to said neighboring cavity to arrange at least a second intersection, wherein the cooling channels intersecting in said at least second intersection are in fluid communication.

17. The stator heat shield according to claim 14, wherein the cooling channels each have a central axis, and the central axes of the cooling channels intersecting in a respective intersection are offset relative to each other so as not to be arranged in one common plane.

18. The stator heat shield according to claim 17, the central axes of the cooling channels intersecting in a respective intersection are half-diameter offset relative to each other.

19. The stator heat shield according to claim 12, wherein the cooling channels each have a central axis, and the central axes of said two cooling channels converge in a respective cavity, as viewed in a plane perpendicular to the first surface of the stator heat shield.

20. The stator heat shield according to claim 1, wherein the cavities are arranged in rows extending in the longitudinal direction of the stator heat shield, as viewed from the first surface.

21. The stator heat shield according to claim 20, wherein the rows of the cavities are staggered.

22. The stator heat shield according to claim 1, wherein the cooling channels are provided as convective cylindrical through channels or tubes.

23. The stator heat shield according to claim 1, wherein the stator heat shield is a cast, machined, brazed or selective laser melted component.

24. A gas turbine, comprising:

at least one stator heat shield according to claim 1.

25. The gas turbine according to claim 24, wherein the cooling fluid is cooling air.

26. A method of cooling a stator heat shield, the stator heat shield having a first surface configured to face a hot gas flow path of a gas turbine, a second surface opposite to the first surface, cooling channels for directing cooling fluid from the second surface towards the first surface, and cavities arranged at the first surface for receiving the cooling fluid from at least a part of the cooling channel, wherein at least a part of each cavity has at least two corresponding cooling channels open thereto, said at least two corresponding cooling channels being inclined towards each other; wherein the method comprises:

causing cooling air to flow through the cooling channels and injecting cooling gas flow of two cooling channels into one cavity, the two cooling channels being offset such that a vortex is created in the cavity.

* * * * *